US010766037B2

(12) United States Patent
Palladini

(10) Patent No.: US 10,766,037 B2
(45) Date of Patent: Sep. 8, 2020

(54) DISCHARGING DEVICE FOR MILLS

(71) Applicant: CERTECH S.P.A. A SOCIO UNICO, Sassuolo (Modena) (IT)

(72) Inventor: Alberto Palladini, Castelnovo ne' Monti (IT)

(73) Assignee: CERTECH S.P.A. A SOCIO UNICO, Sassuolo (IT)

( * ) Notice: Subject to any disclaimer, the term of this patent is extended or adjusted under 35 U.S.C. 154(b) by 175 days.

(21) Appl. No.: 15/759,873

(22) PCT Filed: Nov. 24, 2016

(86) PCT No.: PCT/IB2016/057096

§ 371 (c)(1),
(2) Date: Mar. 14, 2018

(87) PCT Pub. No.: WO2017/115170

PCT Pub. Date: Jul. 6, 2017

(65) Prior Publication Data

US 2018/0290148 A1 Oct. 11, 2018

(30) Foreign Application Priority Data

Dec. 28, 2015 (IT) ..... 102015000087853

(51) Int. Cl.

| | |
|---|---|
| ***B02C 17/18*** | (2006.01) |
| ***B02C 21/00*** | (2006.01) |
| ***B02C 23/36*** | (2006.01) |

(52) U.S. Cl.

CPC ..... *B02C 17/184* (2013.01); *B02C 17/183* (2013.01); *B02C 17/1835* (2013.01); *B02C 21/007* (2013.01); *B02C 23/36* (2013.01)

(58) Field of Classification Search

CPC ... B02C 17/1835; B02C 23/36; B02C 17/184; B02C 17/183; B02C 17/1805; B02C 17/186; B01F 15/00344; B01F 15/0291

See application file for complete search history.

(56) References Cited

U.S. PATENT DOCUMENTS 3,233,835 A * 2/1966 Joseph ..... B01F 9/18 241/72
3,546,821 A * 12/1970 Strom ..... B24B 31/06 451/327
4,801,100 A * 1/1989 Orlando ..... B02C 17/183 141/284

FOREIGN PATENT DOCUMENTS

WO 2015059591 A1 4/2015
WO WO-2015059591 A1 * 4/2015 ..... B02C 17/183

* cited by examiner

*Primary Examiner* — Adam J Eiseman
*Assistant Examiner* — Bobby Yeonjin Kim
(74) *Attorney, Agent, or Firm* — Pearne & Gordon LLP

(57) ABSTRACT

A discharging device for mills, comprising: a conduit (10), structured so as to be connected to a discharge opening (3) of a mill (1); a bend (11) disposed along the conduit (10), which defines a curve of the conduit (10); a regulating device (12) associated to the bend (11) and predisposed for varying the position of the bend (11) so as to vary at least a height thereof.

8 Claims, 2 Drawing Sheets

DISCHARGING DEVICE FOR MILLS

The present invention relates to a discharging device for a mill, in particular for a continuous mill.

For the preparation of the ceramic powders it is widely known to use grinding mills comprising a rotating casing which contains a predetermined mass of grinding bodies.

The substances to be ground in order to obtain the powders are supplied to the mill in a watery suspension. The rotation of the casing produces the continuous mixing of the grinding bodies which progressively reduce the grain size of the substances in watery suspension, up to obtaining a desired grain size.

Mills at present exist that are known as continuous mills, in which the supply and discharge of the liquid suspension take place during the rotation of the casing, without any need for halting. In particular, the supply and discharge take place concentrically to the axis of rotation of the casing.

In order to reduce the energy consumption requested by the rotation of the casing, the liquid level inside the casing is maintained above the axis of rotation of the casing. During the filling step of the casing it is therefore fundamental to precisely establish the liquid level. At present this is done using maximum pressure valves the functioning of which is not particularly precise. Furthermore, these valves, which must work in the presence of a strongly abrasive liquid, are subjected to significant wear.

The aim of the present invention is to offer a discharging device for mills that makes it possible to overcome the drawbacks of the prior art.

An advantage of the present invention is that it enables a very precise regulation of the level of the liquid inside the mill.

A further advantage of the invention is that the level of the liquid is identifiable with the naked eye from outside the rotating casing.

A further advantage of the invention is that it is extremely simple and reliable.

Further characteristics and advantages of the present invention will become more apparent in the following detailed description of an embodiment of the present invention, illustrated by way of non-limiting example in the attached figures, in which.

Figure 1:
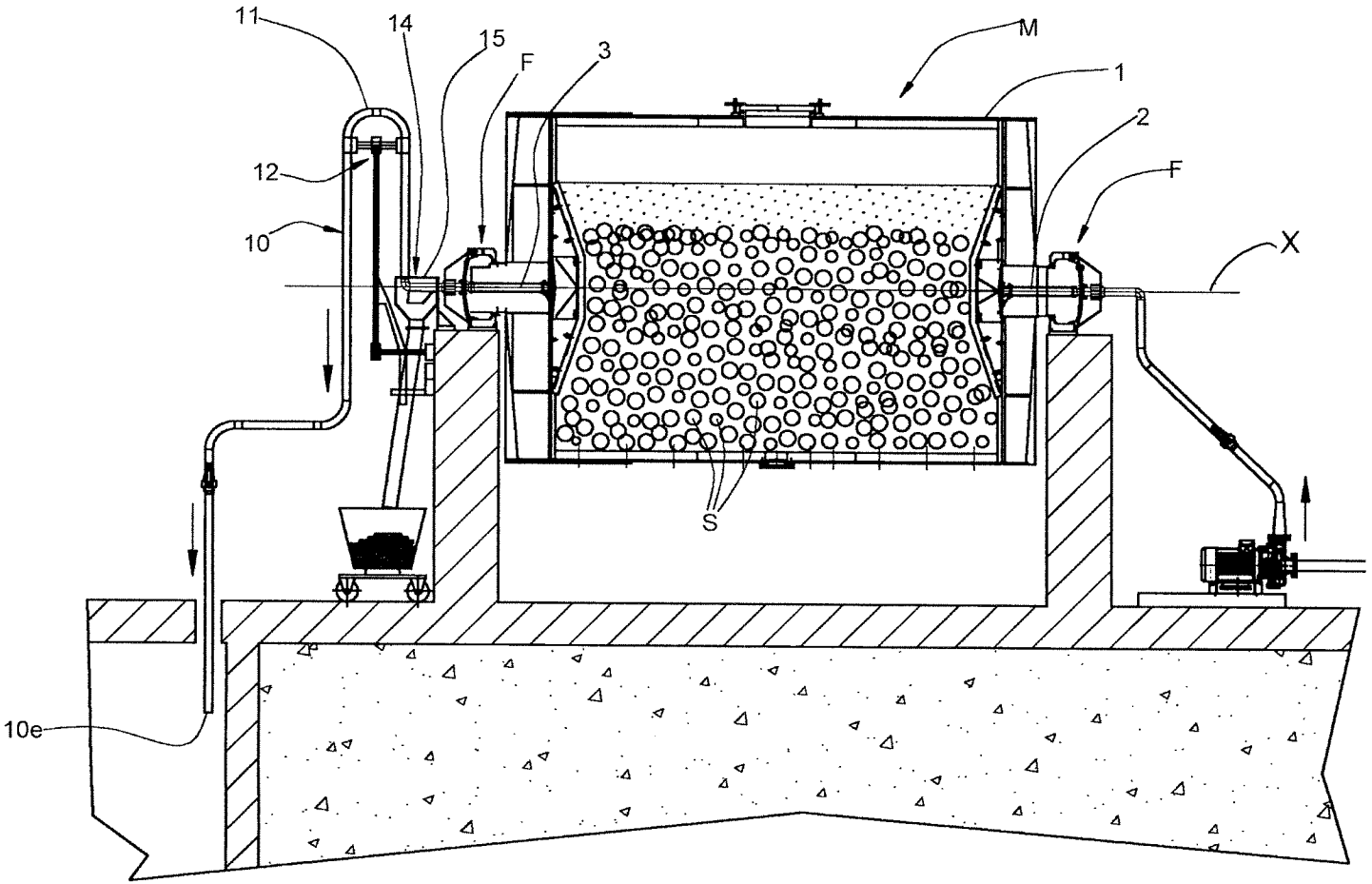
FIG. 1 illustrates a schematic view in section of a mill provided with the discharging device according to the present invention.
Figure 3:
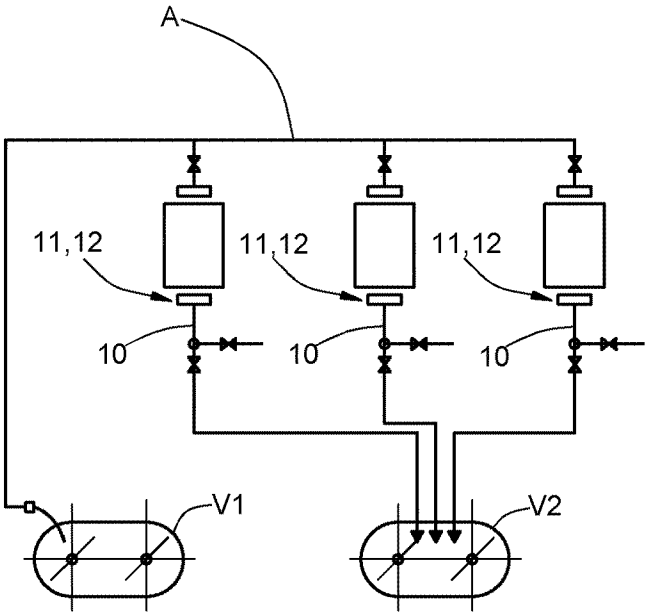
FIG. 3 is a diagram of a possible grinding plant which uses two or more mills according to the present invention.

As mentioned, FIG. 1 schematically illustrates a mill (M) for the grinding of a substance. A typical but not exclusive use of the mill is for grinding a mineral or a mixture of minerals borne in a watery suspension.

The mill comprises a casing (1) having a substantially cylindrical shape and rotating about an axis of rotation (X). The rotation of the casing is achieved by the operating of actuators known to the technical expert in the sector, visible only schematically in FIG. 2. For example the rotation of the casing (1) can be obtained by means of a motor (R) connected to the casing (1) via a transmission belt (T). The casing (1) rotates by means of flanges (F) (not illustrated in detail) that are concentric to the axis of rotation (X) and rotatably associated to supports solidly constrained to a base of the mill (M).

The casing (1) is provided with an inlet opening (2), for supplying the substance to be processed, and an outlet opening (3), for the discharge of the processed substance.

As is known, the casing (1), in working conditions of the mill, contains a predetermined mass of grinding bodies (S) which, during the rotation of the casing (1), drag and impact against one another, producing the milling of the substance to be processed.

In a preferred embodiment of the mill, the inlet opening (2) and the outlet opening (3) are concentric to the axis of rotation (X). As is known in the sector, this enables supplying the substance to be processed during the rotation of the casing (1), i.e. without having to halt the casing (1). The inlet and outlet openings (2, 3) are preferably made through the flanges (F) of the casing (1).

The discharging device according to the present invention comprises a conduit (10), structured so as to be connected to the outlet opening (3) of the mill (M). The conduit (10) is provided with an outlet end (10*e*) predisposed to be located at a lower height than the height of the outlet opening (3). In this way the discharge of the liquid contained inside the casing (1) can take place by force of gravity, i.e. according to the principle of communicating vessels. In the illustrated example the outlet end (10*e*) opens inside of a collecting tub.

The device further comprises a bend (11), arranged along the conduit (10), which defines a curve of the conduit (10). In other terms, the bend (11) defines an elbow, having a more or less sharp curvature, along the conduit (10). The bend (11) might have a curved and continuous conformation, as shown in FIG. 1, or might have a different conformation, for example it might have the shape of an angled fitting between two consecutive stretches of the conduit (10). The fitting might for example be V-shaped or L-shaped.

The bend (11) is arranged with the concavity thereof facing downwards.

The discharging device further comprises a regulating device (12) associated to the bend (11) and predisposed for varying the position of the bend (11) so as to vary at least the height thereof.

The bend (11), by means of the regulating device (12), can be located at a greater height with respect to the outlet opening (3) and to the outlet end (10*e*) of the conduit (10). In this way, during the filling step of the casing (1), the bend (11) defines the maximum level that the liquid can reach inside the casing (1). During the filling of the casing (1), the liquid flows through the outlet opening (3) also inside the conduit (10) up to the height of the bend (11) from which it proceeds towards the outlet end (10*e*). In other terms the liquid level inside the casing (1) cannot exceed the height of the bend (11).

The use of the bend (11) and the regulating device (12) thus enables a precise and very simple regulation of the level of the liquid inside the casing (1). The predetermined level, determined by the regulation of the height of the bend (11), is also well visible to the naked eye from outside the casing (1).

Figure 2:
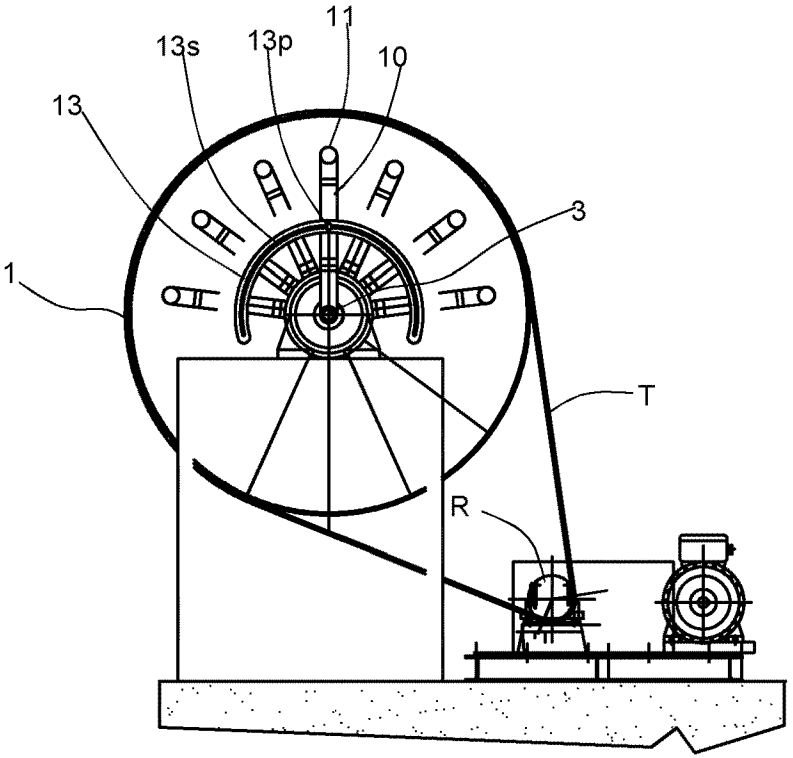
FIG. 2 illustrates a schematic view from the left of the mill of FIG. 1.

In a possible embodiment, the regulating device (12) is structured for rotating at least one intermediate stretch of the conduit (10) comprising the bend (11) about an axis of rotation (X). In this embodiment the axis of rotation (X) of the regulating device (12) coincides with the axis of rotation (X) of the casing (1). As schematically illustrated in FIG. 2, the rotation of the intermediate stretch of the conduit (10) enables varying the height of the bend (11). Overall, at least up to a position in which it is at the same height as the outlet opening (3), the bend (11) faces the concavity thereof in a downwards direction.

To facilitate the rotation, the conduit (10) comprises at least a terminal stretch that is flexible, or the conduit (10) is entirely flexible. For example, the conduit (10), including the bend (11), can be made of rubber or another material which makes the structure thereof flexible. For example, in order to enable easy rotation, at least a stretch of the conduit (10), comprised between the outlet end (10*e*) and the height of the axis of rotation (X), downstream of the bend (11), can be flexible.

In the illustrated embodiment, the regulating device comprises a circular-arc shaped guide (13) concentric to the axis of rotation (X). This guide (13) can be associated to a stable support structure, for example to a support of the casing (1). At least one portion of the conduit (10) is slidably associated to the guide (13). In the illustrated embodiment the guide (13) is provided with a median groove (13*s*) in which a pin (13*p*) solidly constrained to the conduit (10) is slidable.

The regulating device (12) advantageously comprises an actuator, predisposed so as to rotatingly activate the intermediate stretch of the conduit (10) comprising the bend (11) about the axis of rotation (X). This optional actuator has not been illustrated in detail as it is within the scope of knowledge of the technical expert in the sector. Alternatively the regulating device (12) can be manually activated, for example by acting directly on the bend (11) or on the stretch of conduit (10) adjacent to the bend (11), for producing the rotation of the bend (11) about the axis of rotation (X). A blocking mechanism can be predisposed for blocking the position of the bend (11) at a desired height. The blocking mechanism has not been illustrated in detail as it is within the scope of knowledge of the technical expert in the sector. For example it is possible to use a rod, provided with a plurality of notches or niches for jointing, which can be rotatably connected to the bend (11) at an end thereof.

The discharging device according to the present invention advantageously comprises a separator (14) which is so arranged as to allow separation of solid objects from a fluid flowing along the conduit (10). In the case of the mill (M) described herein, the solid objects are substantially constituted by grinding bodies which, following a prolonged work period, are reduced in size due to wear and can transit through the outlet opening (3). Owing to the presence of the separator (14), these solid objects can be retrieved from the conduit (10), which also enables preventing any possible blockage.

The separator (14) comprises for example a container (15) placed in communication with an initial stretch of the conduit (10). The container is arranged below the initial stretch of the conduit (10), so that the solid objects fall internally thereof by force of gravity, at the moment in which they face the communication opening with the conduit (10).

In turn, the container (15) can be provided with a lower discharge opening, possibly provided with a control valve, in order to enable discharge of the accumulated solid objects. The control valve, not illustrated in detail as it is within the scope of knowledge of the technical expert in the sector, can be manually activated or activated by means of an automatic control module.

According to the present invention, two or more mills (M) can be connected in parallel to an inlet manifold (A) for realising a grinding plant.

The inlet manifold (A) can be supplied by means of one or more pumps which collect the substance to be processed from a first container (V1), for example a tub. Each mill (M) discharges the processed substance inside a second container (V2), for example a collecting tub common to all mills (M). Each mill (M) can be provided with the discharging device according to the present invention.

The invention claimed is:

1. A discharging device for mills comprising:

a conduit (10), which is configured to be connected to an outlet opening (3) of a mill (1); a bend (11) disposed along the conduit (10), which defines a curve of the conduit (10); a regulating device (12) associated to the bend (11) and predisposed for varying the position of the bend (11) so as to vary at least the height thereof;

wherein the regulating device (12) is configured for rotating at least one intermediate stretch of the conduit (10) comprising the bend (11) about an axis of rotation (X);

wherein the axis of rotation (X) is aligned with the outlet opening (3) of the mill (1).

2. A discharging device according to claim 1, wherein the regulating device comprises a circular-arc shaped guide (13), which is concentric with the axis of rotation (X).

3. A discharging device according to claim 2, wherein at least one portion of the conduit (10) is slidably associated to the guide (13).

4. A discharging device according to claim 1, wherein the regulating device (12) comprises an actuator, associated to the intermediate stretch of the conduit (10) comprising the bend (11), so as to rotatingly activate the intermediate stretch about the axis of rotation (X).

5. A discharging device according to claim 1, comprising a separator (14) which is arranged to allow separation of solid objects from a fluid flowing along the conduit (10).

6. A discharging device according to claim 1, wherein a separator (14) comprises a container placed in communication with an initial stretch of the conduit (10).

7. A mill for the grinding of a substance comprising a substantially cylindrical-shaped casing (1) and rotating about an axis of rotation (X); an inlet opening (2) being concentric to the axis of rotation (X); an outlet opening (3) being concentric to the axis of rotation (X); wherein the mill further comprises a discharging device;

wherein the discharging device comprises a conduit (10), which is connected to the outlet opening (3); a bend (11) disposed along the conduit (10), which defines a curve of the conduit (10); a regulating device (12) associated to the bend (11) and predisposed for varying the position of the bend (11) so as to vary at least the height thereof;

wherein the regulating device (12) is configured for rotating at least one intermediate stretch of the conduit (10) comprising the bend (11) about the axis of rotation (X);

wherein the axis of rotation (X) is aligned with the outlet opening (3).

8. A plant for the grinding of one or more substances, comprising two or more mills (1) according to claim 7, which are connected in parallel to an inlet manifold (A).

* * * * *